US007758390B2

(12) United States Patent
Domitrovits et al.

(10) Patent No.: US 7,758,390 B2
(45) Date of Patent: Jul. 20, 2010

(54) LARGE ARRAY SURFACE MOUNT TECHNOLOGY CONNECTOR CRADLE ASSEMBLY

(75) Inventors: Michael J. Domitrovits, New Paltz, NY (US); Emanuele F. Lopergolo, Marlboro, NY (US); Prabjit Singh, Poughkeepsie, NY (US); Joseph J. George, Amherst, NH (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/036,933

(22) Filed: Feb. 25, 2008

(65) Prior Publication Data

US 2009/0215289 A1 Aug. 27, 2009

(51) Int. Cl.
*H01R 9/22* (2006.01)

(52) U.S. Cl. ..... 439/715; 439/712; 439/540.1

(58) Field of Classification Search ..... 439/715, 439/701, 76.1, 79, 638, 55, 64, 625, 712, 439/540.1

See application file for complete search history.

(56) References Cited

U.S. PATENT DOCUMENTS 6,814,620 B1 * 11/2004 Wu ..... 439/607.08
7,465,195 B1 * 12/2008 Kerrigan et al. ..... 439/608
2001/0039142 A1 * 11/2001 Maeda et al. ..... 439/540.1

* cited by examiner

*Primary Examiner*—Edwin A. Leon
*Assistant Examiner*—Vanessa Girardi
(74) *Attorney, Agent, or Firm*—Stephen Bongini; Fleit Gibbons Gutman Bongini & Bianco P.L.

(57) ABSTRACT

A large array connector assembly for containing a plurality of wafers is disclosed. The large array connector assembly includes a plurality of guide blocks that includes first and second guide blocks. The first guide block being located at a first end of the assembly. The second guide block being located at a second end of the assembly. A first plate is mechanically coupled to a first portion of the first guide block and a first portion of the second guide block. The first plate includes a plurality of slots each for receiving a tab extending from a corresponding wafer so as to substantially prevent movement of the corresponding wafer in first and second directions while allowing a given degree of movement in a third direction. A second plate is mechanically coupled to a second portion of the first guide block and a second portion of the second guide block.

20 Claims, 5 Drawing Sheets

LARGE ARRAY SURFACE MOUNT TECHNOLOGY CONNECTOR CRADLE ASSEMBLY

FIELD OF THE INVENTION

The present invention generally relates to the field of large array connectors, and more particularly relates to the assembly and mounting of a surface mount technology connector onto a circuit board.

BACKGROUND OF THE INVENTION

Large array connectors are generally used to connect multiple wafers to one or more circuit boards. A large array connector can include hundreds of wafers that each have multiple leads. Therefore, a large array connector can house thousands of leads that are to be mounted to a printed circuit board ("PCB"). A large array connector can be used to couple a functional side of the wafers to a mid-plane (e.g., motherboard) and leads of the wafers to a PCB such as a daughter card. This allows the daughter card and mid-plane to communicate with each other.

Conventional large array connectors are assembled prior to shipment using a stiffener or organizer. This stiffener/organizer comprises the connector and can be referred to as a "connector" or "cradle assembly". Individual wafers are loaded into the organizer, inspected, and shipped to the customer. However, assembly, measurement and shipping practices have proven ineffective in producing a reliable connector assembly that meets the current co-planarity and true position specifications that are required for mounting the wafers to PCBs. Stated differently, conventional large array connector assemblies do not provide a high degree of positional accuracy and co-planarity with respect to the wafers for properly mounting the wafers to a PCB.

SUMMARY OF THE INVENTION

A large array connector assembly for containing a plurality of wafers is disclosed. The large array connector assembly includes a plurality of guide blocks that includes first and second guide blocks. The first guide block being located at a first end of the large array connector assembly. The second guide block being located at a second end of the large array connector assembly. A first plate is mechanically coupled to a first portion of the first guide block and a first portion of the second guide block. The first plate includes a plurality of slots each for receiving a tab extending from a corresponding wafer so as to substantially prevent movement of the corresponding wafer in first and second directions while allowing a given degree of movement in a third direction. A second plate is mechanically coupled to a second portion of the first guide block and a second portion of the second guide block.

In another embodiment, an electronic assembly is disclosed. The electronic assembly includes a printed circuit board comprising a plurality of mounting location. A large array connector assembly is mechanically coupled to the printed circuit board. The large array connector containing a plurality of wafers. The large array connector assembly comprises a plurality of guide blocks including first and second guide blocks. The first guide block being located at a first end of the large array connector assembly. The second guide block being located at a second end of the large array connector assembly. A first plate mechanically coupled to a first portion of the first guide block and a first portion of the second guide block. The first plate comprising a plurality of slots each for receiving a tab extending from a corresponding wafer so as to substantially prevent movement of the corresponding wafer in first and second directions while allowing a given degree of movement in a third direction. A second plate mechanically coupled to a second portion of the first guide block and a second portion of the second guide block.

In yet another embodiment a large array connector assembly for containing a plurality of wafers is disclosed. The large array connector assembly comprises a plurality of guide blocks including a first guide block mechanically coupled to a first end of the large array connector assembly, a second guide block mechanically coupled at a second end of the large array connector assembly, a third guide block, and a fourth guide block. The third and fourth guide blocks are mechanically coupled to the large array connector assembly at locations equidistant from the first end and second end, respectively. A first plate mechanically coupled to a first portion of the first guide block, a first portion of the second guide block, a first portion of the third guide block, and a first portion of the fourth guide block. The first plate comprising a plurality of slots each for receiving a tab extending from a corresponding wafer so as to substantially prevent movement of the corresponding wafer in first and second directions while allowing a given degree of movement in a third direction. A second plate mechanically coupled to a second portion of the first guide block, a second portion of the second guide block, second portion of the third guide block, second portion of the fourth guide block.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention.

DETAILED DESCRIPTION

Embodiments of the present invention incorporate a cradle assembly configured so that wafers can float within the assembly. This allows the leads of the wafers to conform to the mounting surface of a PCB. This ability to conform vastly improves solderability between the leads and surface mount pads on the PCB. Additionally, the cradle assembly of embodiments of the present invention limits or prevents substantial movement and maintains a wafer's position in the x-y direction, while applying a minimal force in the z direction. This ensures that each wafer properly contacts conductive bonding materials on the PCB.

Large Array Connector Cradle Assembly

Figure 1:
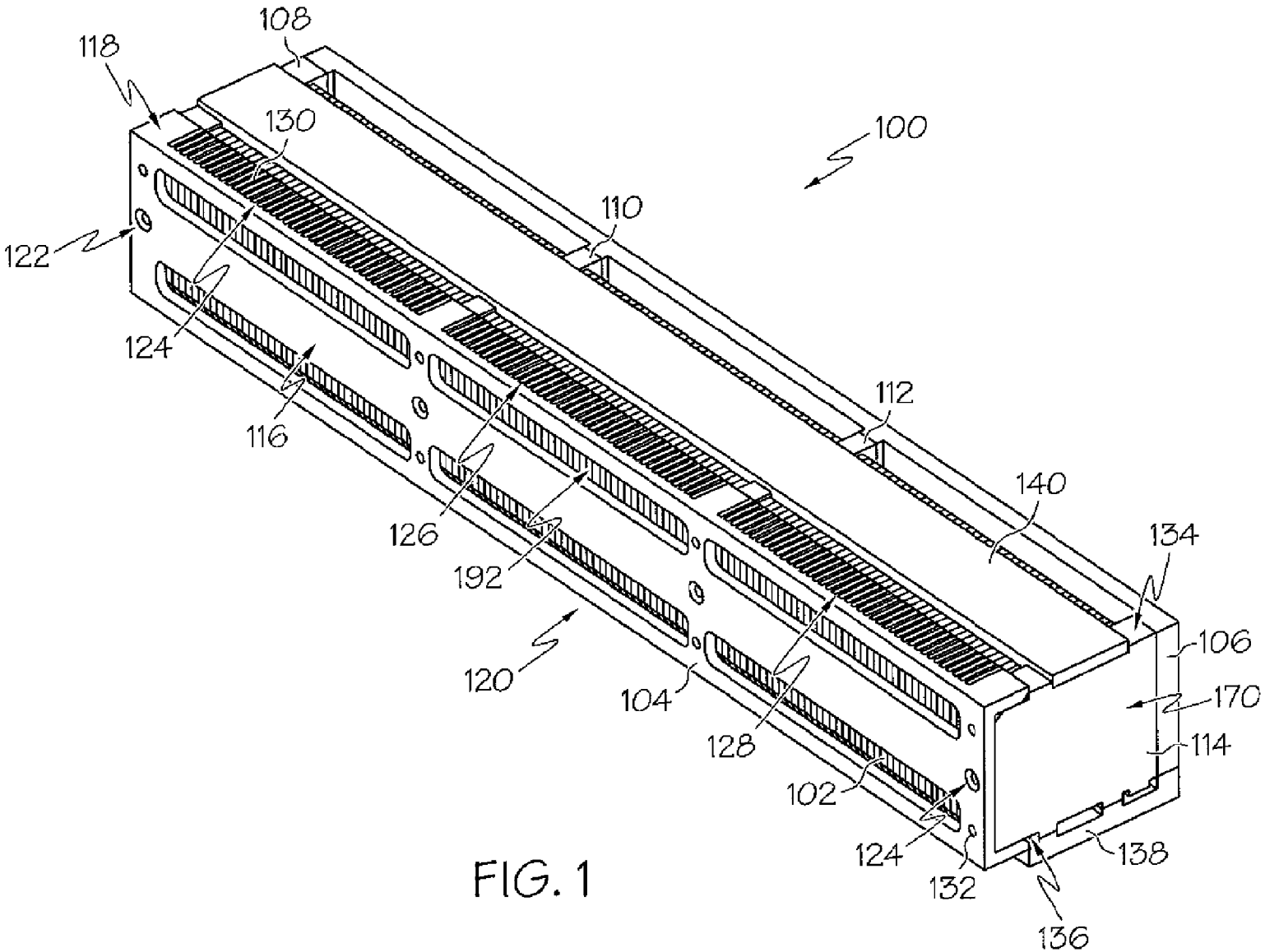
FIG. 1 shows a front perspective view of a cradle assembly according to one embodiment of the present invention.
Figure 2:
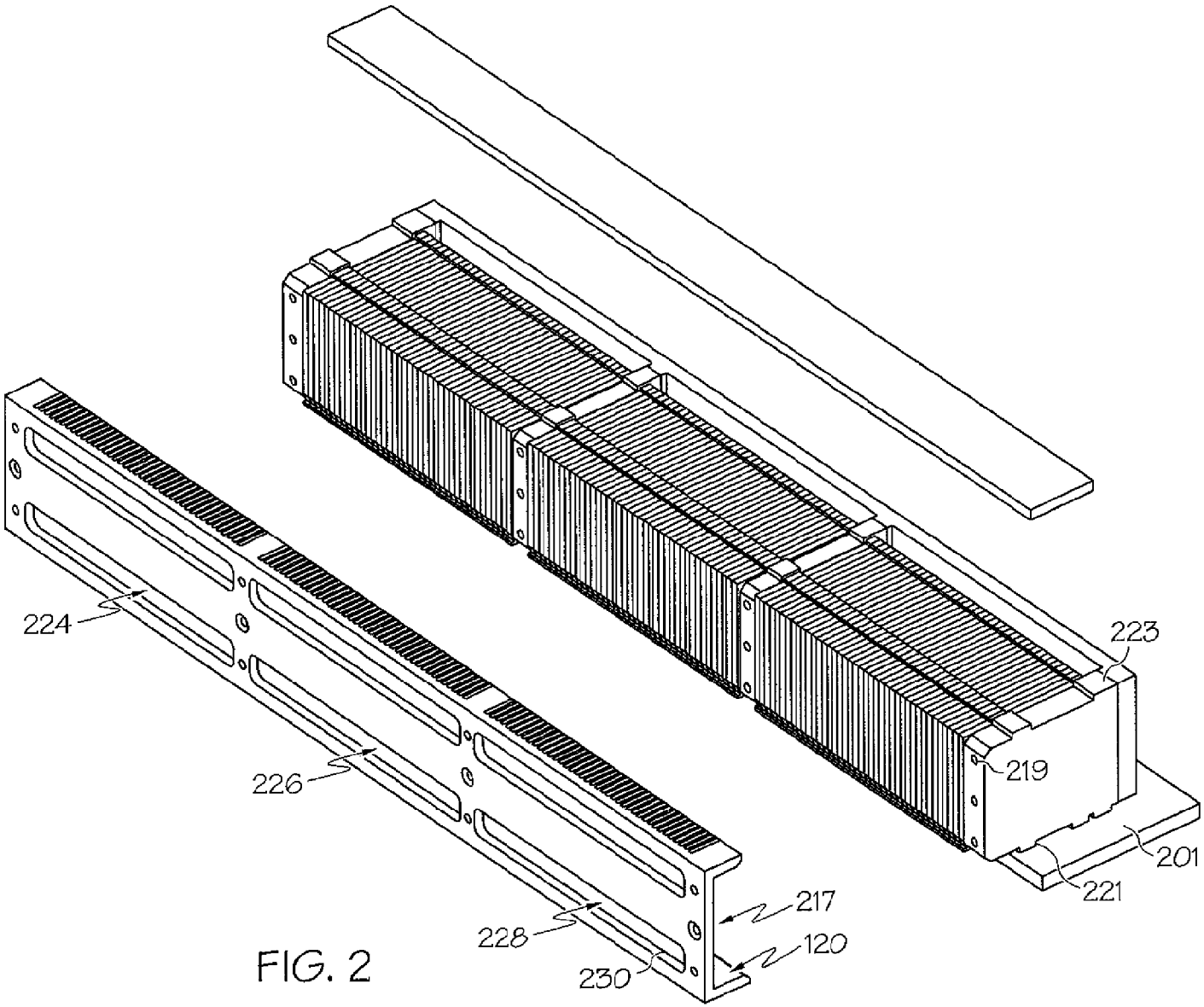
FIG. 2 shows an exploded view of the cradle assembly of FIG. 1.

FIG. 1 is a front perspective view of a large array connector cradle assembly according to one embodiment of the present invention. FIG. 2 is an exploded view of the cradle assembly of FIG. 1. The cradle assembly 100 allows wafers 102 within the cradle assembly 100 to float within the assembly 100 so that the leads of the wafers 102 can conform to the surface of a PCB 201. This ability to conform vastly improves solderability between the leads and surface mount pads on the PCB 201. Rather than preassembling a large array connector at the manufacturer, the cradle assembly 100 of this embodiment is used to load the desired connector configuration. The large array connector is used to mate the wafers 102 to the PCB 201 (such as a daughter card) and also to a mid-plane, so as to allow the mid-plane and daughter card to communicate with one another. In this embodiment, the connector is part of the cradle assembly 100 and remains on the PCB 201 with the wafers 102 once the wafer leads have been conductively bonded to the PCB 201. One example of a connector is discussed in greater detail in co-pending U.S. patent application entitled "Large Array Connector for Coupling Wafers with a Printed Circuit Board", Ser. No. 12/036,878, which was filed on the same day as the present application and is commonly assigned herewith to International Business Machines Corporation (of Armonk, N.Y.). This related application is incorporated herein by reference in its entirety.

The cradle assembly 100 also limits or prevents substantial movement and maintains a wafer's position in the x-y direction, while applying a minimal force in the z direction. This ensures that each wafer 102 properly contacts conductive bonding materials such as (but not limited to) solder on the PCB 201. This, in turn, decreases the flatness requirements for both the PCB 201 and connector, and maintains the true position and co-planarity of each wafer 102. Thus, the overall cost of the connector is reduced. The cradle assembly 100 also provides an improved mechanism for connector rework, should a portion of the connector need replacement. Conventional connector assemblies generally comprise a thin sheet of metal, referred to as "an organizer". This organizer is usually placed on the top of the assembly and the wafers slide into the organizer. This configuration has the disadvantage that the wafers are able to move laterally in the x-y direction, which decreases the positional accuracy of the wafers. For example, when the conventional assembly is lowered onto the PCB, the wafers may not be coplanar since they can move laterally. This can create many problems during the conductive bonding process of the wafers to the PCB.

The cradle assembly 100 of this embodiment of the present invention includes a front plate 104, a back plate 106, and one or more guide blocks 108, 110, 112, and 114 that help maintain positional accuracy and co-planarity of the wafers 102. The cradle assembly 100 also includes a top plate 140, which is used to place each wafer 102 onto its corresponding surface mount pads of the PCB 201. The cradle assembly 100 further includes a protective plate 138 that covers the leads of each wafer 102 during shipment.

The cradle assembly 100 allows for the wafers 102 to be conductively bonded onto the surface pads of the PCB 201 at the correct positions and also aligns the wafers for proper mating with a mid-plane. In this embodiment, the front plate 104, back plate 106 and one or more guide blocks 108, 110, 112, and 114 are separate components. However, one or more of the front plate 104, back plate 106 and guide blocks 108, 110, 112, and 114 can be manufactured as a single integral component. Also, the back plate 106, one or more of the guide blocks 108, 110, 112, and 114, and optionally the top plate 140 make up the connector.

The front plate 104 and back plate 106 of this embodiment are mechanically coupled to one or more of the guide blocks 108, 110, 112, and 114 (collectively referred to as "guide block 108" or "guide blocks 108"). The guide blocks 108 provide structural support to the wafers 102, the cradle assembly 100, and the back plate 106 after the wafers have been conductively bonded to the PCB 201. For example, the guide blocks 108 provide support in the x-y direction to the wafers 102 and can also be mechanically coupled to back plate 106 or top plate 140 to provide a more rigid structure for the connector after the wafers 102 are soldered to the PCB 201. The guide blocks 108 also provide rough alignment for mating a front face (also referred to as the "functional end") of each wafer 102 with a corresponding receptacle of a mid-plane. The guide blocks 108, in this embodiment, also act as a hard stop when the functional ends of the wafers 102 are seated within the mid-plane.

In this embodiment, the guide blocks 108 are recessed so that the functional ends of the wafers 102 extend beyond the guide blocks 108. In another embodiment, the guide blocks 108 are flush with the functional ends of the wafers 102. Also, the guide blocks 108 can extend beyond a rear face of the wafers 102 and/or be recessed with respect to the rear faces of the wafers 102.

The front plate 104, in the embodiment of FIG. 1, includes a front portion 116, a rear portion 217, a top portion 118, a bottom portion 120, a first side portion 122, and a second side portion 125. Each of the top portion 118 and the bottom portion 120 extend in an outward direction, so as to create a "C" or "U" configuration with the front portion 116 and rear portion 204, which are substantially perpendicular to the top portion 118 and the bottom portion 120. The front plate 104, in this embodiment, also includes one or more sets 124, 126, 128 of grooves/slots 130 on the top portion 118. FIG. 2 also shows one or more sets 224, 226, and 228 of grooves/slots 230 on the bottom portion 120. The rear portion 217 can also include one or more sets of grooves/slots.

The back plate 106, in this embodiment, also comprises one or more sets 324, 326, and 328 of grooves/slots 330. These grooves/slots 130, 230, 330, are configured to accept features such as ribs and/or tabs on a wafer 102, so that each wafer 102 maintains its position within the cradle assembly 100 and remains co-planar. The grooves/slots 130, 230, 330 allow for the wafers 102 to be accurately soldered on the PCB 201 and mated to a mid-plane.

The front plate 104 of this embodiment also includes one or more fastening areas 132 for receiving a fastener to mechanically couple the front plate 104 to a corresponding guide block 108. The guide block 108 also includes one or more fastening areas 219, 221, and 223 that correspond to the fastening areas 132 of the front plate 104 (and/or back plate 106) for receiving the fasteners. Although FIG. 1 and FIG. 2 show the fastening areas 132 on the front portion (which extend though to the rear portion), fastening areas can also be included on the top and bottom portions 118 and 120. In one embodiment, the top portion 118 of the front plate 104 extends over a top portion 134 of each guide block 108. The bottom portion 120 of the front plate 104 can also extend under the bottom portion 136 of each guide block 108. The top portion 118 and the bottom portion 120 of the front plate 104 can also rest flush against the guide block 108.

Figure 3:
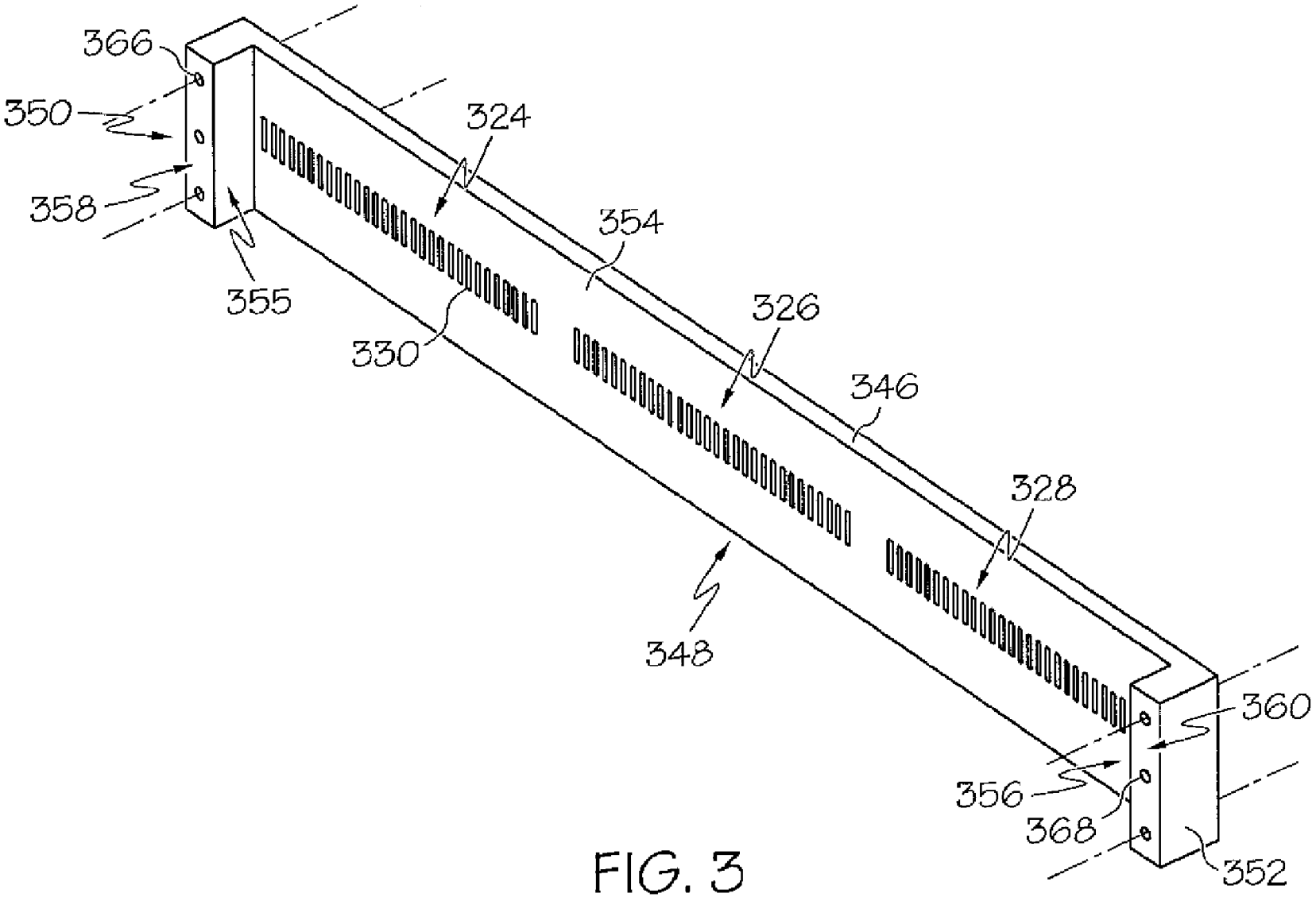
FIG. 3 shows a front perspective view of the back plate of the cradle assembly of FIG. 1.

The back plate 106 can be seen in more detail in FIG. 3, which shows a front perspective view of the back plate 106. In this embodiment, the back plate 106 includes a top portion 346, a bottom portion 348, a first side portion 350, a second side portion 352, a front portion 354, and a back portion. The top portion 346 and bottom portion 348 of the back plate 106 are situated flush with the top portion 134 and bottom portion 136 or the guide block 108, respectively.

However, the back plate 106 can also be configured similar to the front plate 104 so that the top portion 346 and bottom portion 348 extend in an outward fashion similar to the front plate 104. This creates a "C" or "U" configuration with the front portion 354 and rear portion of the back plate 106, which are substantially perpendicular to the top portion 346 and the bottom portion 348. In such an embodiment, the top portion 346 and bottom portion 348 can rest on top of the top portion 134 and underneath the bottom portion 136 of the guide block 108, respectively.

Alternatively, the top portion 346 and the bottom portion 348 can be extended, as explained above, and rest flush with the top and bottom surfaces 134 and 136 of the guide block 108. In yet another embodiment, the top portion 346, bottom portion 348, first side portion 350, and second side portion 352 can all extend outwards as shown in FIG. 3. In this embodiment, the back plate 106 also includes a third side portion 355, fourth side portion 356, a first front facing portion 358, and a second front facing portion 360.

As discussed above, the back plate 106 of this embodiment also includes slots or grooves 330 that receive a rear rib of each wafer 102. The slots or grooves 330 provide support to the wafers 102 so that movement in the x-y direction is limited or prevented. The slots or grooves 330 can also be configured to allow movement in the z direction (i.e., up and down) so that the wafers 102 can float within the cradle assembly 100 during a surface mounting process.

The back plate 106 can also include one or more fastening areas 366 and 368 situated at various locations that are similar to the fastening areas 132 of the front plate 104, which are described above. The fastening areas 366 and 368 allow various types of fasteners to mechanically couple the back plate 106 to the guide blocks 108. For example, the first and second front facing portions 358 and 360 rest flush against an outer facing portion 170 of the guide blocks 108. Alternatively, in an embodiment where the top portion 346 and/or the bottom portion 348 extend outwards, the fastening areas 366 and 368 can be located on the top portion 346 and/or the bottom portion 348 of the back plate 106. In such an embodiment, the fastening areas 366 and 368 correspond to fastening areas 223 and 221 on the top portion 134 and bottom portion 136 of the guide blocks 108, respectively. The back plate 106 and one or more of the guide blocks 108 can be manufactured as separate components or as a single integral piece.

The back plate 106 is not limited to the embodiment shown in FIG. 3. For example, the top portion 346, bottom portion 348, first side portion 350, and/or the second side portion 352 do not have to extend in an outward fashion. The front portion 354 of the back plate 106 can rest flush against one or more portions of the guide blocks 108. In such an embodiment, the fastening areas 366 and 368 of the back plate 106 are situated on the front portion 354 and rear portions of the back plate 106.

Figure 4:
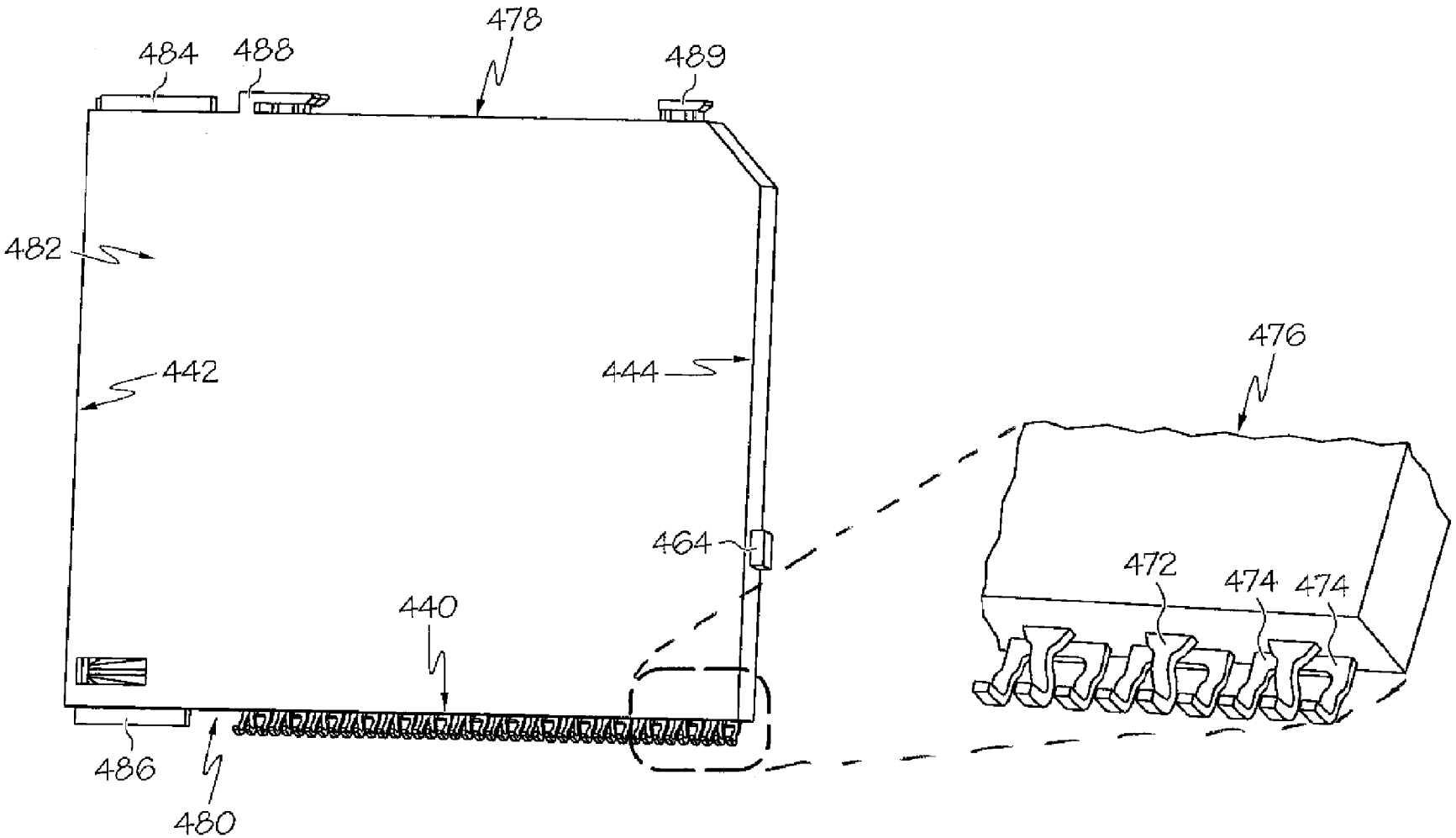
FIG. 4 shows a side perspective view of a PCB wafer according to one embodiment of the present invention.

FIG. 4 is a side perspective view of a wafer. The wafer 102 can have various dimensions such as (but not limited to) 1.7 mm thick×43 mm high×35 mm wide. This exemplary wafer 102 is molded from a synthetic material such as (but not limited to) plastic, and has two planes of metallization such as (but not limited to) copper. The planes of metallization make up the signal plane and ground plane of the leads 440. The leads 440 comprise signal leads 472 and ground leads 474, as shown in the exploded view 476 of the leads 440. In this embodiment, each signal lead 472 has a ground lead 474 on each of its sides. The ground leads 474 isolate the signal lead 472 from noise and other interference. The leads 440, in this embodiment, are surface mounted onto surface pads of a PCB 201.

The wafer 102 comprises a top face 478, a bottom face 480, a front face 442, a rear face 444, a first side face 482, and a second side face. The front face 442 of the wafer 202 is the "functional end" of the wafer and can be referred to as the "separable interface" or "pluggable end" of the wafer 202. This functional end mates with the mid-plane and allows a PCB 201 such as a daughter card to communicate with the mid-plane.

The top face 478 comprises a top rib or tab 484 and optional appendages 488 and 489. The bottom face 480 includes the leads 440 and a bottom rib or tab 486. The top rib 484 is configured to fit within a corresponding slot 130 on the top portion of the front plate 104 of the cradle assembly 100. The bottom rib 486 is configured to fit within a corresponding slot 230 on the bottom portion 120 of the front plate 104 of the cradle assembly 100. The rear face 444 includes a rear rib 464. The rear rib 464 is configured to fit within a corresponding slot 330 of the back plate 106.

The top rib 484 and bottom rib 486 are also configured to mate with a corresponding receptacle on the mid-plane. The optional appendages 488 and 489 have varying functions such as spacing the wafer 102 from a top plate 140 of the assembly 100 and/or aligning the wafer 102 for proper bonding with the PCB 201. However, all embodiments do not include the ribs 464, 486, and 488. For example, in an alternative embodiment the slots 130, 230, and 330 are configured to hold a portion of the front face 442, rear face 44, and/or the top face 478.

Figure 5:
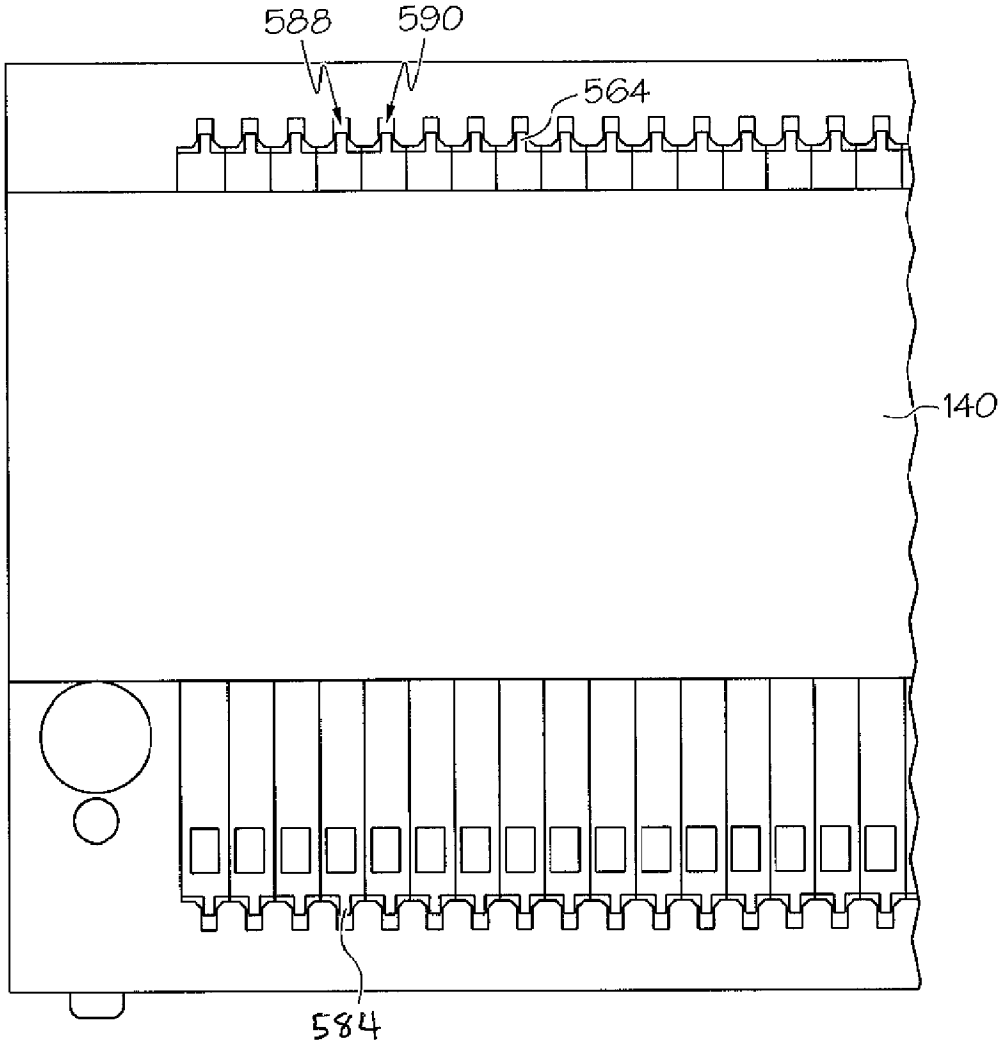
FIG. 5 shows a partial top perspective view of the cradle assembly of FIG. 1.

FIG. 5 shows a top partial view of the cradle assembly. This view illustrates the top rib 484 of the wafer 102 and the rear rib 464 of the wafer 102 situated within their respective front plate slot 130 and rear back plate slot 330. The bottom rib 486 of the wafer 102 is also residing within its corresponding slot 220 on the front plate 104. However, the bottom rib 486 is not shown in the view of FIG. 5. At least a portion of a rib 484 and 486 extends into the corresponding groove/slot 130 and 330.

The walls 588 and 590 of the grove/slot 130 and 330 prevent or restrict lateral movement in the x-y direction to a given degree. For example, the grooves/slots 130 and 330 and/or ribs 486 and 464 can be configured to allow a minimal amount of movement such as (but not limited to) 0.05 mm. Therefore, the cradle assembly 100 is able to maintain the wafers 102 at a given position and co-planarity. The wafers 102 are slid into their corresponding grooves/slots one by one or in sets of N wafers at a time. For example, if the cradle assembly is sectioned off by the guide blocks 108 into three different sections (e.g., with each section comprising 40 slots) as shown in FIG. 1 and FIG. 2, 40 wafers at a time can be placed within the cradle assembly 100. Further, all of the wafers 102 can be placed into the cradle assembly at once.

The slots 130, 230, and 330 of this embodiment are configured to allow the wafers 102 to float within the cradle assembly 100. For example, the wafers 102 are able to move in the z direction (i.e., up and down) within the grooves/slots 130, 230, and 330. This allows each wafer 102 to conform to the surface of the PCB 201.

Returning now to FIG. 1, after the wafers are situated within the cradle assembly 100, the top bar/plate 140 is coupled to the cradle assembly 100. In this embodiment, the top bar/plate 140 is situated on one or more extending areas such as the fastening areas 223 on the top surface 134 of the guide blocks 108, so as to create a small gap between the wafers 102 and the top bar/plate 140. This top bar/plate 140 can be made of a flexible material that can withstand high temperatures during the mounting process, such as (but not limited) silicone. In another embodiment, the top bar/plate 140 includes a rigid material for enhancing the rigidity of the cradle assembly 100 and connector.

After the customer receives the cradle assembly 100 from the manufacturer, the protective cover 138 is removed from the leads 440. The cradle assembly 100 is fastened to the PCB 201 by the guide blocks 108 and/or the back plate 106, as explained above. The guide blocks 108 are mechanically coupled to the PCB 201 by, for example, one or more fasteners. For example, in one embodiment each guide block 108 includes one or more fastening areas 221 that align the guide blocks 108 with corresponding fastening areas on the PCB 201. By fastening the guide blocks 108 and/or the back plate 106 to the PCB 201, the cradle assembly 100 and the components of the cradle assembly 100 (such as the guide blocks 108 and back plate 106) that make up the connector, a more rigid structure is created. Also, mechanical support can be provided to each wafer 102 and positional accuracy and co-planarity of the wafers 102 is maintained when conductively bonding the wafers 102 to the PCB 201 and when plugging the wafers 102 into a mid-plane.

After the guide blocks 108 and/or the back plate 106 are fastened to the PCB 201, the mounting of the wafer leads to the PCB can be performed. Conventional methods are used to prepare the PCB by stenciling the PCB and screening solder paste on the pads of the PCB. A conventional assembly is then placed onto the PCB and a top load is applied to the entire assembly. Current specifications such as those set by the Association Connecting Electronics Industries mandate that 1 pound of pressure is to be applied for each wafer within an assembly. Therefore, if the assembly has 120 wafers, 120 pounds of pressure is applied to the entire conventional assembly.

As explained above, a conventional assembly has an organizer on the top portion of the assembly. This organizer is generally made of thin sheet metal. Therefore, when the top load is applied to the entire assembly, the assembly can twist, so as to misalign the leads of the wafers and the surface mount pads of the PCB. Additionally, the conventional connector assembly does not provide any mechanisms to maintain the co-planarity of the wafers or the true position of the SMT leads on the functional end of the wafers. The wafers can either tilt or shift during placement of the assembly onto the PCB. This causes the wafers to also become misaligned with the surface mount pads on the PCB.

In contrast, embodiments of the present invention implement grooves/slots 130, 230, and 330 on the front plate 104 and back plate 106, as described above. This causes the leads 440 of each wafer 102 to be accurately aligned with the surface mount pads of the PCB 201. The grooves/slots 130, 230, and 330 prevent the wafers 102 from shifting and/or tilting out of position, so as to maintain positional accuracy and co-planarity of the wafers 102 with respect to the PCB 201 and the mid-plane. The wafers 102 can be made of different materials such as plastics and metals. Therefore, the heating and/or cooling experienced by the wafers 102 during the conductive bonding process causes the wafers 102 to move.

This movement is prevented or at least contained by the cradle assembly 100 of the present invention. Also, because the wafers 102 are able to move in the z direction (i.e., up and down) within the cradle assembly 100, less force needs to be applied to the wafers 102 to ensure sufficient contact of the leads 440 with the surface mount pads of the PCB 201. For example, a top load can be applied to the top bar/plate 140, which causes the top bar 140 to press down onto the wafers 102. Therefore, the load is not applied to the entire cradle assembly 100 as in conventional assemblies, but to each wafer 102 individually. Each wafer 102 deflects downwards so that the leads 440 can contact the conductive bonding material. Because a smaller load is experienced by the wafers 102, less stress is placed on the solder joints between the leads 440 and the surface mount pads on the PCB 201.

Additionally, the front plate 104, back plate 106, and/or top plate 140 of the cradle assembly 100 can include openings 192, as shown in FIG. 1. The openings 192 reduce the mass of the plates 104 and 106, so that less heat is transferred to the plates 104 and 106 during the conductive bonding process. This allows for the leads 440 to be soldered to the PCB 201 more quickly. After the leads 440 have been bonded to the PCB 201, the front plate 104 and top plate/bar 140 can be removed, shipped back to, and reused by the manufacturer. Because the wafers 102 were situated in the slots/grooves 130, 230, 330 during the conductive bonding process, the wafers are properly aligned with their corresponding receptacles on the mid-plane.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the appended claims.

Embodiments of the present invention can be implemented in hardware or software, or in a combination of hardware and software. For example, one embodiment of the present invention is implemented in hardware such as a large array connector assembly. In another embodiment, the present invention is implemented in software such as that used for controlling and performing the assembly of a large array connector assembly.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically. The terms program, software application, and the like as used herein, are defined as a sequence of instructions designed for execution on a computer system. A program, computer program, or software application may include a subroutine, a function, a procedure, an object method, an object implementation, an executable application, an applet, a servlet, a source code, an object code, a shared library/dynamic load library, and/or other sequence of instructions designed for execution on a computer system.

What is claimed is:

1. A large array connector assembly for containing a plurality of wafers, the large array connector assembly comprising:

a plurality of guide blocks including first and second guide blocks, the first guide block being located at a first end of the large array connector assembly, and the second guide block being located at a second end of the large array connector assembly;

a first plate comprising first and second portions, the first portion of the first plate being perpendicular to the second portion of the first plate, the second portion of the first plate being mechanically coupled to a first portion of the first guide block and a first portion of the second guide block, the first plate further comprising a plurality of slots each for receiving a tab extending from a corresponding wafer so as to substantially prevent movement of the corresponding wafer in first and second directions while allowing a given degree of movement in a third direction, the slots being located on the first portion of the first plate; and a second plate mechanically coupled to a second portion of the first guide block and a second portion of the second guide block.

2. The large array connector assembly of claim 1, wherein each of the slots maintains the corresponding wafer at a position that corresponds to a mounting location on a printed circuit board.

3. The large array connector assembly of claim 1, wherein each of the slots maintains the corresponding wafer at a position that corresponds to a mating location on a mid-plane.

4. The large array connector assembly of claim 1, wherein the first portion of the first plate and a third portion of the first plate extend from the second portion of the first plate, the first and third portions of the first plate are substantially parallel to each other, and the second portion of the first plate is substantially perpendicular to the first and third portions of the first plate.

5. The large array connector assembly of claim 1, wherein the tab extends from a front portion of the corresponding wafer that is configured to mate with a mid-plane.

6. The large array connector assembly of claim 1, wherein the second plate comprises a plurality of slots for receiving another tab extending from each of the corresponding wafers so as to substantially prevent movement of the corresponding wafers in the first and second directions while allowing a given degree of movement in the third direction.

7. The large array connector assembly of claim 1, further comprising a third plate that is mechanically coupled to a third portion of the first guide block and a third portion of the second guide block.

8. The large array connector assembly of claim 1, further comprising a protective cover substantially covering leads that extend from the corresponding wafers.

9. The large array connector assembly of claim 1, wherein the first plate is detachable from the first guide block and the second guide block.

10. An electronic assembly comprising:

a printed circuit board comprising a plurality of mounting locations; and a large array connector assembly mechanically coupled to the printed circuit board, the large array connector containing a plurality of wafers, wherein the large array connector assembly comprises:

a plurality of guide blocks including first and second guide blocks, the first guide block being located at a first end of the large array connector assembly, and the second guide block being located at a second end of the large array connector assembly;

a first plate mechanically coupled to a first portion of the first guide block and a first portion of the second guide block, the first plate comprising a plurality of slots each for receiving a tab extending from a corresponding wafer so as to substantially prevent movement of the corresponding wafer in first and second directions while allowing a given degree of movement in a third direction;

a second plate mechanically coupled to a second portion of the first guide block and a second portion of the second guide block; and a third plate mechanically coupled to a third portion of the first guide block and a third portion of the second guide block.

11. The electronic assembly of claim 10, wherein each of the slots maintains the corresponding wafer at a position that corresponds to a mounting location on a printed circuit board.

12. The electronic assembly of claim 10, wherein each of the slots maintains the corresponding wafer at a position that corresponds to a mating location on a mid-plane.

13. The electronic assembly of claim 10, wherein the tab extends from a front portion of the corresponding wafer that is configured to mate with a mid-plane.

14. The electronic assembly of claim 10, wherein the second plate comprises a plurality of slots for receiving another tab extending from each of the corresponding wafers so as to substantially prevent movement of the corresponding wafers in the first and second directions while allowing a given degree of movement in the third direction.

15. The electronic assembly of claim 10, wherein the first plate is detachable from the first guide block and the second guide block.

16. A large array connector assembly for containing a plurality of wafers, the large array connector assembly comprising:

a plurality of guide blocks including a first guide block mechanically coupled to a first end of the large array connector assembly, a second guide block mechanically coupled at a second end of the large array connector assembly, a third guide block, and a fourth guide block, wherein the third and fourth guide blocks are mechanically coupled to the large array connector assembly at locations equidistant from the first end and second end, respectively;

a first plate comprising first and second portions, the first portion of the first plate being perpendicular to the second portion of the first plate, the second portion of the first plate being mechanically coupled to a first portion of the first guide block, a first portion of the second guide block, a first portion of the third guide block, and a first portion of the fourth guide block, the first plate further comprising a plurality of slots each for receiving a tab extending from a corresponding wafer so as to substantially prevent movement of the corresponding wafer in first and second directions while allowing a given degree of movement in a third direction, the slots being located on the first portion of the first plate; and a second plate mechanically coupled to a second portion of the first guide block, a second portion of the second guide block, a second portion of the third guide block, and a second portion of the fourth guide block.

17. The large array connector assembly of claim 16, wherein each of the slots maintains the corresponding wafer at a position that corresponds to a mounting location on a printed circuit board.

18. The large array connector assembly of claim 16, wherein each of the slots maintains the corresponding wafer at a position that corresponds to a mating location on a mid-plane.

19. The large array connector assembly of claim 16, wherein the tab extends from a front portion of the corresponding wafer that is configured to mate with a mid-plane.

20. The large array connector assembly of claim 16, wherein the second plate comprises a plurality of slots for receiving another tab extending from each of the corresponding wafers so as to substantially prevent movement of the corresponding wafers in the first and second directions while allowing a given degree of movement in the third direction.

* * * * *